US006467395B2

(12) United States Patent
Graham

(10) Patent No.: US 6,467,395 B2
(45) Date of Patent: Oct. 22, 2002

(54) PISTON PUMP WITH FLOATING SEAL

(76) Inventor: Stephen H. Graham, 425 Appian Way, El Sorrante, CA (US) 94803

( * ) Notice: Subject to any disclaimer, the term of this patent is extended or adjusted under 35 U.S.C. 154(b) by 34 days.

(21) Appl. No.: 09/808,647

(22) Filed: Mar. 14, 2001

(65) Prior Publication Data

US 2002/0129702 A1 Sep. 19, 2002

(51) Int. Cl.[7] ..... F16J 15/18
(52) U.S. Cl. ..... 92/168; 277/370
(58) Field of Search ..... 92/168, 165 R; 277/511, 361, 362, 370

(56) References Cited

U.S. PATENT DOCUMENTS 3,922,957 A 12/1975 Ogle
4,173,437 A 11/1979 Leka
4,790,236 A * 12/1988 Macdonald et al. ..... 403/122
5,144,882 A 9/1992 Weissgerber
5,299,813 A 4/1994 McKenna
5,890,415 A * 4/1999 Asou ..... 417/470

* cited by examiner

*Primary Examiner*—Edward K. Look
*Assistant Examiner*—Thomas E. Lazo
(74) *Attorney, Agent, or Firm*—Howard Cohen

(57) ABSTRACT

A pump includes a piston rod and precision bearings that eliminate radial movement of the piston rod while permitting reciprocal axial translation. A piston extends axially from the piston rod, and is received in a cylinder in a pump head. A static seal assembly includes an annular ring received about the piston in a leakproof sliding engagement, the ring being formed of a soft polymer material. The annular ring is encapsulated in an outer ring formed of a stiff plastic material, defining a self-contained seal cartridge. The outer ring is dimensioned to be received in the pump head in a cylindrical recess that permits radial freedom relative to the axis of the cylinder. To assemble the pump, the seal cartridge is first assembled to the piston, thus assuring that the seal is aligned with the piston. Thereafter, the head is assembled to the pump body, the piston being inserted in the cylinder and the seal cartridge being received with clearance in the recess. Subsequently, the head is tightened, immobilizing the seal cartridge in the aligned relationship with the piston.

11 Claims, 2 Drawing Sheets

PISTON PUMP WITH FLOATING SEAL

BACKGROUND OF THE INVENTION

The present invention relates to reciprocating piston pumps and, more particularly, to high pressure, low flow rate pumps such as those used in high pressure liquid chromatography.

Reciprocating pumps used for precision liquid metering, such as HPLC, are usually comprised of a piston made from a brittle material such as sapphire or ceramic, and a seal made from a fluoropolymer compound. The piston is mounted on a piston rod that is driven from the distal end by a cam follower (push rod). The piston is usually made with a large length to diameter ratio, and is easily broken if care is not taken to provide for proper alignment in the design. Also, pistons are often broken during assembly or when the seals are changed unless great care is taken by the user during this process. Furthermore, any misalignment of the piston with the pump seal will cause rapid seal wear during operation.

In the prior art, pump manufacturers have relied on allowing the piston rod to float radially to prevent piston and seal misalignment. In this case, the seal is usually pressed into a recess in the pump head, and the seal is assembled to the piston as the head is mounted to the pump frame. There are many disadvantages to this method:

1. The seal is often damaged when it is pressed into the recess of the pump head. The diameter of the seal is always larger than the pump head recess into which it must be pressed, and unless the user is very careful, the seal will be damaged when it is pressed into place.
2. The piston is easily broken when the head is mounted to the piston. Once the seal has been successfully pressed into the pump head, the seal must then be pressed onto the piston in the same operation as the head is mounted on the pump chassis. This is a frequent cause of piston breakage because the head is rather heavy, and the force required to press the seal onto the piston can be quite high, so unless the user is extremely careful in aligning all components, the sapphire or ceramic piston will break.
3. The methods that are used to allow the piston rod to float are inherently unstable. The driving force for the piston rod is from the distal end. This end is usually either a rounded or flat surface that is supposed to slide on the push rod to permit a radial floating engagement. The proximal end of the piston depends on the seal, or a bushing behind the seal, for alignment.

The radial force required to align the piston in this case can be very large because of the moment arm that exists: (piston+piston rod length) X (axial load from fluid pressure) X (coefficient of friction) between piston end and push rod, and the seal or seal backup bushing is required to provide this force. The piston assemblies are usually required to be quite long to accommodate the stroke length and return spring, and the metal bearing at the piston rod end is often compromised by corrosion due to leakage during use with corrosive solvents, and by brinnelling over time. The result is large side loads on the seal and seal backup bearing, and short seal life.

Unfortunately, the general tendency toward rapid wear of the seal and seal backup bearing necessitates frequent component replacement, and each component replacement procedure increases the risk of breaking the brittle piston itself.

SUMMARY OF THE INVENTION

The present invention generally comprises a piston pump that is particularly adapted to provide high pressure output at low flow rates. A salient aspect of the invention is the provision of a floating seal arrangement that enables alignment of the seal with the piston, thereby reducing seal wear and improving the ease and success of assembly of the seal components in the pump.

The pump generally includes a pump chassis or body having one or more bores formed therein that are dimensioned to receive a piston rod. The piston rod is supported in the bore by precision bearings that virtually eliminate radial movement of the piston rod while permitting reciprocal axial translation. A piston extends axially from a proximal end of the piston rod, and is dimensioned to be received in a respective cylinder formed in a pump head.

The piston is sealed in the cylinder by a seal assembly that has both static and dynamic aspects. The static seal assembly includes an annular ring having a central aperture dimensioned to receive the piston in a leakproof sliding engagement, the ring being formed of a soft polymer material. The annular seal ring is encapsulated in an outer ring formed of a stiff plastic or polymer material, defining a self-contained seal cartridge. The outer ring is dimensioned to be received in the pump head in a cylindrical recess that permits positional freedom with respect to the axis of the cylinder.

The pump is assembled in a manner that assures alignment of the piston and seal cartridge while minimizing the risk of breaking the brittle piston. In the assembly process, the seal cartridge is first assembled to the respective piston, thus assuring that the seal is aligned with the piston. Thereafter, the head is assembled to the pump body, the pistons being inserted in their respective cylinders and the seal cartridges being received with clearance in their respective recesses. Subsequently, the head is tightly secured to the pump body, causing the seal cartridges to be immobilized in their recesses in the aligned relationships that have been previously established with respect to the pistons. The large radial clearance between the seal cartridge and the head recess eliminates side loading on the piston by the seal or head during installation, thus preventing piston breakage. In addition, it is not necessary to press the seal into the head, so that damage to the seal during installation is eliminated.

DESCRIPTION OF THE PREFERRED EMBODIMENT

Figure 1:
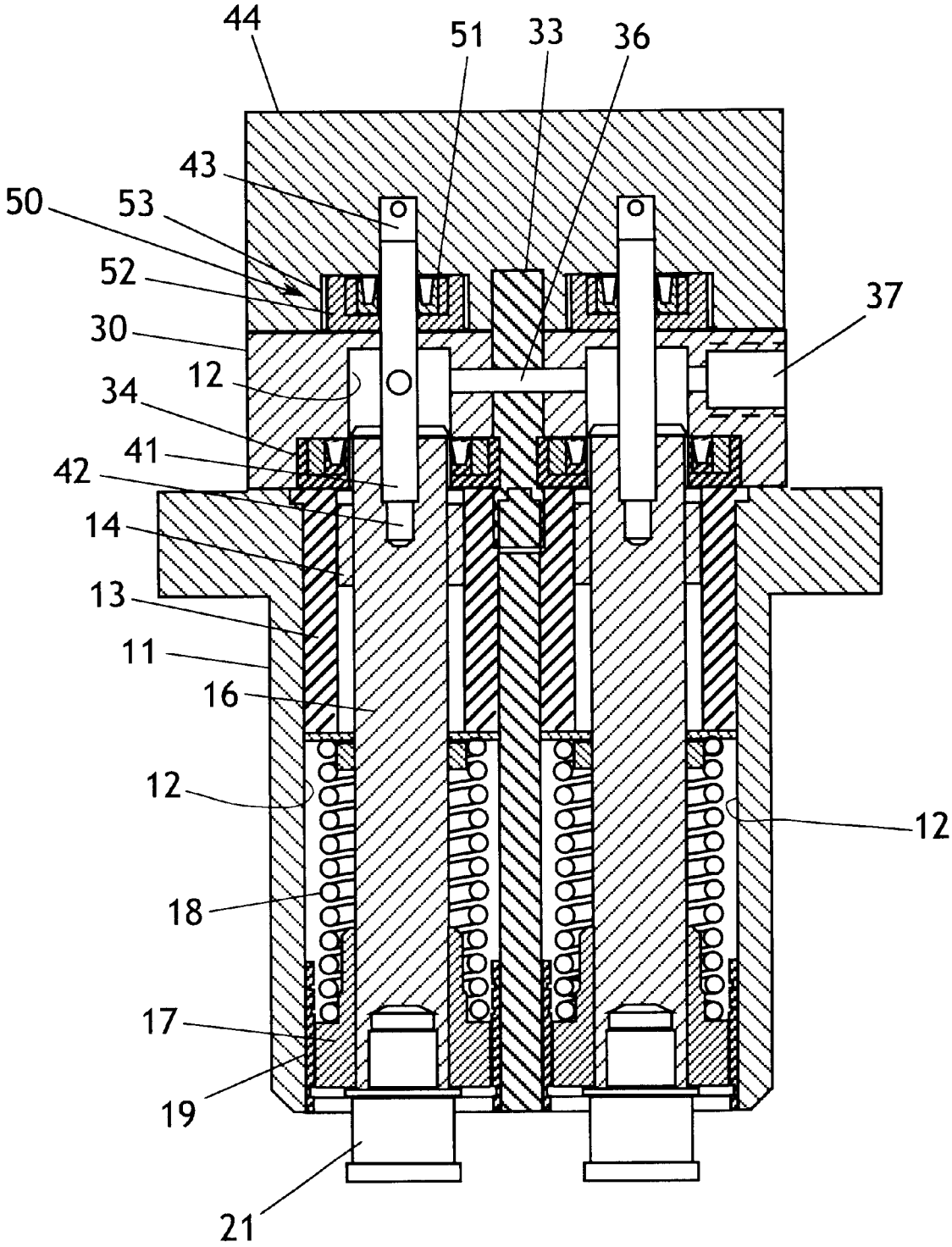
FIG. 1 is a cross-sectional elevation showing the pump assembly of the present invention.

The present invention generally comprises a piston pump adapted to provide high pressure output at low flow rates for purposes such as HPLC analysis. With regard to FIG. 1, the pump includes a pump chassis or body 11 having a pair of bores 12 extending therein in parallel fashion. (Any number of bores from one to several may be provided, depending on the desired capacity of the pump.) Each bore 12 includes a sleeve liner 13 having at its proximal end a precision bearing 14. A piston rod 16 is disposed within the bore and is supported by the bearing 14 in a fashion that permits free axial reciprocal translation and no radial movement. At the distal end of the rod 16 a spring keeper sleeve 17 is secured to the rod, and a compression spring 18 is secured about the piston rod 16 between. the keeper 17 and the distal end of the sleeve liner 13. A precision bearing or bushing 19 is secured within the distal end of the bore 12 to support the keeper sleeve in freely sliding fashion without permitting radial play of the piston rod 16. A block 21 is secured to the distal end of the piston rod 16, and is adapted to be engaged by a rotating cam or a similar reciprocating mechanism to urge the piston rod in reciprocal motion against the restoring force of spring 18.

The bores 12 extend into a pump body extension 30, which is removably secured to the body 11 and aligned therewith by at least one locating pin 33. Each bore 12 is provided with a seal assembly 34 that engages the proximal end of the respective reciprocating piston rod 16 in sealing fashion. The inner end of each bore is connected by a flow passage 36, and thence to an outlet connection 37, so that the bores 12 may be controlled to prevent pneumatic drag to the piston rods 12.

A piston 41 is secured within a bore 42 extending axially into the proximal end of the piston rod 16. Although the rod 16 is typically formed of a machinable metal, the piston 41 is formed of a very hard, inert substance such as sapphire or the like. Each piston 41 is received within a respective cylinder 43 formed in a pump head 44 that is removably assembled to the pump extension 30. The locating pin 33 extends into a complementarily formed bore in the pump head 44 to aid in alignment with the pump extension and pump body. Each cylinder 43 includes inlet and outlet ports and associated check valves, as are known in the prior art, to permit intake of fluid and output of the fluid under high pressure.

A salient feature of the invention is the provision of a seal assembly 50 to engage each piston 41. The seal assembly 50 includes an annular ring 51 having a central aperture dimensioned to receive the piston 41 in a sliding, sealed relationship. The ring 51 is formed of a soft polymer material or the equivalent, and is provided with an annular V-shaped spring to maintain radial force on the piston 41, as is known in the prior art. The ring 51 is encapsulated in a concentric outer ring 52 formed of a relatively stiff plastic or polymer material. (For very high pressure outputs, the ring 52 may be enclosed in a external ring (not shown) formed of stainless steel or the like.) The ring 52 is dimensioned to be received in a cylindrical recess 53 formed in the pump head 44, the recess 53 having a diameter greater than the ring 52, whereby the ring 52 is provided with positional freedom with respect to the axis of the recess 53. Note however that the depth of the recess is slightly less than the thickness of the ring 52. If an external stainless steel ring is employed, then the external steel ring will be slightly smaller in thickness than the depth of the recess 53.

Figure 2:
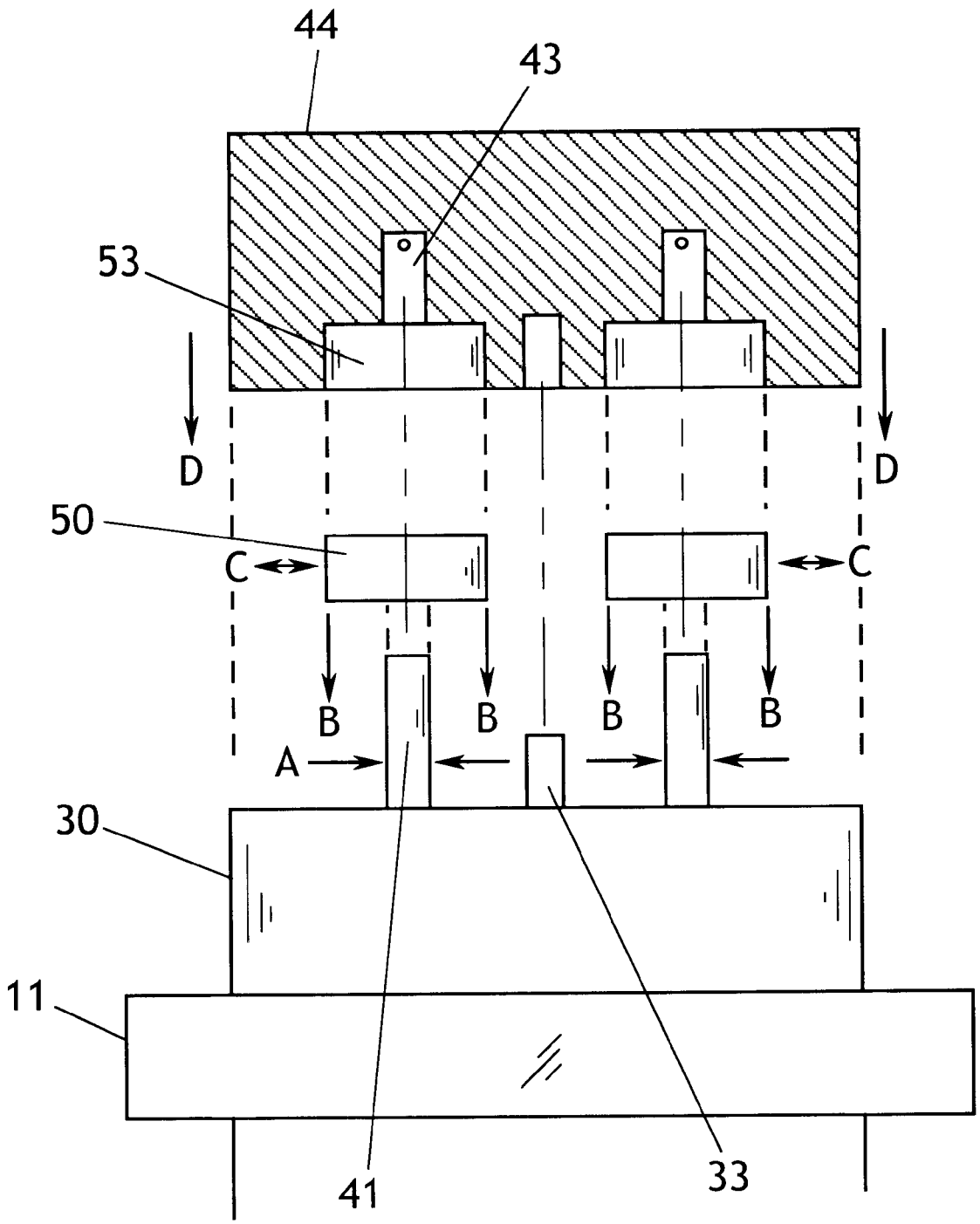
FIG. 2 is a schematic view of the assembly steps for the pump of the present invention.

FIG. 2 depicts schematically the assembly steps for the pump described above. The spatial relationships of the components enumerated above are chosen to assure alignment of the piston 41 and, the seal assembly 50 while also minimizing the risk of breaking the frangible piston. The piston rod 16 is prevented from floating radially within the bore 12, and is thus maintained in axial alignment with the bore 12. Likewise, each piston 41 and cylinder 43 are disposed in axial alignment (A). When the head 44 is to be assembled to the pump body 11 and extension 30, each seal assembly 50 is first assembled (B) to the respective piston 41, which extends outwardly proximally from the extension 30. This assembly step assures that the seal assembly 50 is axially aligned concentrically (C) with the respective piston 41, so that there is no radial loading on the piston. This factor minimizes seal wear as well as minimizes the opportunity to break the piston during assembly.

Thereafter the head 44 is joined to the assembly of the extension 30 and pump body 11, as shown at D. The locating pins 33 provide correct alignment for the pistons to be introduced into their respective cylinders. The locating pins 33 provide alignment of the head to the pump body. Because of the radial clearance between the seal assembly and the recess in the head, the alignment of the head to the body is far less critical than prior art arrangements. Moreover, the loose fit of the seal assembly 50 in the recess 53 enables the seal assembly to establish a position in which there is no radial loading on the piston. The head is then secured to the pump body assembly, and the impingement of the recess 53 on the thickness of each seal assembly 50 serves to immobilize the seal assembly in the established, no-radial-loading position. Thus seal wear is minimized, and piston breakage is prevented. Disassembly of the pump assembly involves reversal of the assembly steps.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. In a pump having a piston mounted in a pump body and a cylinder formed in a pump head, the improvement comprising:

a seal assembly adapted to be secured about the piston prior to assembly of the pump head to the pump body;

a recess formed in the pump head, said recess disposed generally concentrically to the cylinder, said recess dimensioned to receive said seal assembly with free play in a radial direction, said recess having a depth such that assembly of the pump head to the pump body compresses said seal assembly axially and immobilizes said seal assembly in said recess.

2. The improved pump of claim 1, wherein said recess has a depth substantially equal to the axial height of said seal assembly.

3. The improved pump of claim 1, further including a piston rod disposed in a bore within the pump body, said piston rod aligned axially with said piston and said cylinder.

4. The improved pump of claim 3, further including bearing means in said bore for supporting said piston rod in freely reciprocating fashion with no radial free play.

5. The improved pump of claim 1, wherein said piston extends from said piston rod in axial alignment therewith.

6. The improved pump of claim 1, wherein said seal assembly includes an inner annular ring having a central aperture dimensioned to receive the piston therethrough in leakproof sealing relationship.

7. The improved pump of claim 6, wherein said inner annular ring is formed of soft polymer material.

8. The improved pump of claim 6, wherein said seal assembly includes an outer ring in which said inner annular ring is embedded.

9. The improved pump of claim 8, wherein said outer ring is formed of a stiff polymer material.

10. The improved pump of claim 8, wherein said inner annular ring and said outer ring are concentric.

11. A method for assembly of a pump having a piston mounted in a pump body and a cylinder formed in a pump head, including the steps of:

providing a seal assembly and securing said seal assembly in annular fashion about said piston, whereby said seal assembly is disposed in concentric relationship to said piston;

providing a recess in said pump head to receive said seal assembly, said recess having a diameter greater than said seal assembly to permit radial free play for said seal assembly, said recess having a depth no greater than the axial height of said seal assembly;

joining said pump head to said pump body to compress said seal assembly in said recess and immobilize said seal assembly in concentric relationship to said piston.

* * * * *